US006280912B1

(12) United States Patent
Whitesides et al.

(10) Patent No.: US 6,280,912 B1
(45) Date of Patent: Aug. 28, 2001

(54) PROTECTIVE OVERCOAT FOR AN IMAGING ELEMENT COMPRISING AN ENZYME-TREATED BIOPOLYMER

(75) Inventors: Thomas H. Whitesides; Amy Jasek; Hwei-Ling Yau; Jill E. Fornalik, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/665,463

(22) Filed: Sep. 19, 2000

(51) Int. Cl.[7] ..... G03C 1/76; G03C 5/305; G03C 11/06; G03C 11/08

(52) U.S. Cl. ..... 430/350; 430/432; 430/448; 430/493; 430/523; 430/531; 430/536; 430/961

(58) Field of Search ..... 430/350, 463, 430/493, 432, 448, 536, 537, 961, 523, 531, 248, 205

(56) References Cited

U.S. PATENT DOCUMENTS 3,565,618 * 2/1971 Marechal ..... 430/252
4,567,131 * 1/1986 Watkiss ..... 430/205
5,853,926 * 12/1998 Bohan et al. ..... 430/350
5,856,051 * 1/1999 Yau et al. ..... 430/537
5,866,312 * 2/1999 Wang et al. ..... 430/537
5,910,391 * 6/1999 Kondo et al. ..... 430/204
5,958,658 * 9/1999 Smith et al. ..... 430/537
6,187,517 * 2/2001 Whitesides et al. ..... 430/350

* cited by examiner

*Primary Examiner*—Richard L. Schilling
(74) *Attorney, Agent, or Firm*—Chris P. Konkol

(57) ABSTRACT

The present invention provides an overcoat for a photographic element that allows for appropriate diffusion of photographic processing solutions. The overcoat comprises 10 to 50% by weight of a enzyme-degradable biopolymer and 50 to 90% by weight of hydrophobic particles (by weight of dry laydown of the entire overcoat). An enzyme is applied to the element before, during, or after conventional photoprocessing. According to one embodiment of the invention, the photographic element can be exposed and processed using normal photofinishing equipment, with no modifications, to provide an imaged element together with a protective, water-resistant layer.

28 Claims, No Drawings

PROTECTIVE OVERCOAT FOR AN IMAGING ELEMENT COMPRISING AN ENZYME-TREATED BIOPOLYMER

FIELD OF THE INVENTION

The present invention relates to photographic elements having a protective overcoat that resists fingerprints, common stains, and spills. More particularly, the present invention provides a processing-solution-permeable protective overcoat for the photographic element that is water resistant in the final processed product. The overcoat, before formation of the image, comprises hydrophobic polymeric particles in a matrix of a hydrophilic biopolymer. Hydrolysis of the biopolymer by an enzyme allows the biopolymer to wash out of the overcoat during processing, so that coalescence of the hydrophobic particles in the overcoat can occur, resulting in the formation of a continuous water-resistant protective overcoat.

BACKGROUND OF THE INVENTION

Gelatin has been used extensively as a binder in a variety of imaging elements because of its many unique and advantageous properties. For example, its water swellability allows processing chemistry to be carried out to form silver halide-based photographic images. However, due to this same property, imaged elements containing gelatin, no matter if they are formed on transparent or reflective media, have to be handled with extreme care to avoid contact with any aqueous solutions that may damage the images. Accidental spillage of common household solutions such as coffee, punch, or even plain water can damage imaged elements such as photographic prints.

There have been attempts over the years to provide protective layers for gelatin-based photographic systems that will protect the images from damage by water or aqueous solutions. U.S. Pat. No. 2,173,480 describes a method of applying a colloidal suspension to moist film as the last step of photographic processing before drying. A number of patents describe methods of solvent coating a protective layer on the image after photographic processing is completed and are described, for example, in U.S. Pat. Nos. 2,259,009, 2,331,746, 2,798,004, 3,113,867, 3,190,197, 3,415,670 and 3,733,293. More recently, U.S. Pat. No. 5,376,434 describes a protective layer formed on a photographic print by coating and drying a latex on a gelatin-containing layer bearing an image. A drawback is that the photographic materials need to be coated after the processing step. Thus, the processing equipment needs to be modified and the personnel running the processing operation need to be trained to apply the protective coating.

Various lamination techniques are known and practiced in the trade. U.S. Pat. Nos. 3,397,980, 3,697,277 and 4,999,266 describe methods of laminating a polymeric sheet film, as a protective layer, on a processed image. However, protective coatings that need to be applied to the image after it is formed, several of which were mentioned above, add a significant cost to the final imaged product.

A number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (for example, ammonium carbonate), and removing the extender by sublimation or dissolution during processing. The overcoat as described is coated as a suspension in an organic solvent, and thus is not desirable for large-scale application.

More recently, U.S. Pat. No. 5,853,926 to Bohan, et al., discloses a protective coating for a photographic element, involving the application of an aqueous coating comprising polymer particles and a soft polymer latex binder. This coating allows for appropriate diffusion of photographic processing solutions, and does not require a coating operation after exposure and processing. The hydrophobic polymer particles must be fused to form a protective coating that is continuous and water-impermeable.

The ability to provide the desired property of post-process water/stain resistance of an imaged photographic element, at the point of manufacture of the photographic element, and in a way that involves minimal or no changes in the photofinishing operation, is a highly desired feature. However, in order to accomplish this feature, the desired photographic element must be permeable to aqueous solutions during the processing step, but become water impermeable or water resistant after the processing is completed. Commonly assigned U.S. Ser. No. 09/235,436 discloses the use of a processing-solution-permeable overcoat that is composed of a urethane-vinyl copolymer having acid functionalities. Commonly assigned U.S. Ser. No. 09/235,437 and U.S. Ser. No. 09/448,213 disclose the use of a second polymer such as a soluble gelatin or polyvinyl alcohol to improve permeability.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene having a melting temperature (Tm) of 55 to 200° C., and therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. The fusing step is simple and environmentally friendly to photofinishing laboratories. Similarly, commonly assigned U.S. Ser. No. 09/353,939 (Docket 79581) and U.S. Ser. No. 09/548,514 (docket 80493), respectively, describe the use of a polystyrene-based material and a polyurethane-based material, with gelatin as the binder, in an overcoat for a photographic element, which overcoat can be fused into a water resistant overcoat after photographic processing is accomplished to generate an image. Like the polyethylene overcoats described above, the protective properties of this overcoat are compromised by the necessity to form a continuous film in the presence of gelatin in the layer. The type of polymers that can be used may not afford protective overcoats with the most desirable durability or scratch resistance. Further, the photofinishing operation must include a fusing step in order to achieve a protective layer.

Commonly assigned Ser. No. 09/547,374 (Docket 80610) and Ser. No. 09/591,430 (Docket 80962) describe the use of a proteolytic enzyme, either incorporated into one of the processing solutions or into the photographic element itself during manufacture, which enzyme allows the gelatin to be removed from a nascent protective layer during photoprocessing. The resulting overcoat becomes water resistant upon drying. These methods of forming a protective overcoat may suffer from the fact that the underlying imaging layers are also coated in gelatin. In practice, it is difficult to control the degree of hydrolysis using proteolytic enzymes so that only the gelatin in the overcoat layer is digested and none of the gelatin in the imaging layers is affected. When some or all of the imaging layers are digested by the enzyme, in addition to the overcoat, some or all of the image records in the imaging layers become soluble in the processing solutions and are washed off. In extreme cases, the imaging layers may be entirely dissolved, so that only the bare photographic support remains. In any case, the imaging capability of the element can potentially be degraded by the use of such enzymes.

Therefore, there remains a need for, and it would be highly desirable to obtain, an overcoat applied to a photographic element before development that would not significantly reduce the rate of reaction of the developer with the underlying emulsions, that would require minimal modifications of the photofinishing operation, that would ultimately provide a water resistant and durable overcoat after the processing or developing step, and that would provide a robust means of activating the formation of that overcoat, without risk of damage to the image.

SUMMARY OF THE INVENTION

The present invention provides a protective overcoat for a photographic element, the precursor or nascent form of which allows for appropriate diffusion of photographic processing elements. The nascent overcoat is applied to the gelatin-containing photographic element as a composition comprising 10 to 50% by weight of a hydrophilic, enzyme-degradable, biopolymer other than gelatin and 50 to 90% by weight of hydrophobic polymeric particles (by weight of dry laydown of the entire overcoat) having an average diameter of 10 to 500 nm. The term "biopolymer" is used herein to include naturally occurring polymers or unmodified or chemically-modified biopolymers ("derivatives thereof"). By "naturally occurring" is meant biosynthesized by an animal, plant, or microorganism.

An enzyme capable of hydrolyzing the hydrophilic, enzyme-degradable biopolymer in the nascent overcoat may be applied to the element with the nascent overcoat, during manufacture of the element, either in the same coating operation (using a slide hopper or other means of applying multiple layers at the same time), in a sequential coating operation (using a separate coating station), or in a separate coating step, to produce a photographic element comprising a nascent overcoat in which the hydrophilic, enzyme-degradable, biopolymer is partially or completely hydrolyzed or degraded by the enzyme. Accordingly, the photographic element can be exposed and processed using normal photofinishing equipment with no modifications to provide an imaged element together with a protective, water-resistant layer. Fusing this layer may improve the protective properties of the overcoat in the element, but is not generally required in order to achieve good protective characteristics. Alternatively, instead of being included during manufacture of the photographic element, the enzyme can be incorporated into one of the processing solutions, so that hydrolysis of the biopolymer in the overcoat layer occurs during the photofinishing operation. The hydrophobic particles can be introduced into the overcoat coating melt in a latex form or as a colloidal dispersion. The particle size is preferably from 10 nm to 500 nm, more preferably from 30 nm to 250 nm. Any polymeric material that is capable of forming a protective layer and that can be coated in mixture with the hydrophilic biopolymer can be used in this invention. By the term "fusing" herein is meant the combination of pressure and heat wherein the heat is applied at a temperature of from 35 to 175° C., typically with a pressure roller or belt.

The present invention thus provides a photographic element comprising at least one imaging layer, to which is applied an overcoat layer comprising a hydrophobic, film-forming polymer together with an enzyme-degradable non-gelatin biopolymer, together with a hydrolytic enzyme capable of acting on the enzyme-degradable non-gelatin biopolymer to activate the protective properties of the overcoat layer so that the processed element possesses water-resistance. The term "non-gelatin" is used herein to mean a biopolymer that is not gelatin or derived from gelatin. The present invention also is directed to a method of making an imaged element in which the image-wise exposed photographic element comprising a non-gelatin biopolymer-containing overcoat is treated with an enzyme that is capable of substantially digesting the biopolymer but substantially incapable of digesting gelatin under conventional conditions of photoprocessing such as RA-4 and the like.

DETAILED DESCRIPTION OF THE INVENTION

As indicated above, the present invention provides a novel photographic element containing a nascent protective overcoat activated by enzymolysis. Examples of a photographic element for which such an overcoat is desirable are provided by photographic prints, which potentially encounter substantial abuse during normal handling by end-users. In one embodiment, the overcoat formulation of this invention comprises 50% to 90% by weight (based on the dry laydown of the overcoat) of hydrophobic polymer particles that are 10 nm to 500 nm in average size and 10% to 50% by weight (based on the dry laydown of the overcoat) of a non-gelatin biopolymer. Other common addenda, such as hardeners (crosslinkers for the gelatin), speed control dyes, matte particles, spreading agents, charge control agents, dry scratch resistance compounds and lubricants can also be included in the formulation as needed.

The colloidal dispersions of hydrophobic polymers used in this invention are generally latexes or hydrophobic polymers of any composition that can be stabilized as dispersed particles in a water-based medium. Such hydrophobic synthetic polymers are generally classified as either condensation polymer or addition polymers. Condensation polymers include, for example, polyesters, polyamides, polyurethanes, polyureas, polyethers, polycarbonates, polyacid anhydrides, and polymers comprising combinations of the above-mentioned types. Addition polymers include, for example, polymers or copolymers formed from polymerization of vinyl-type monomers such as allyl compounds, vinyl ethers, vinyl heterocyclic compounds, styrenes, olefins and halogenated olefins, unsaturated acids and esters derived from them, unsaturated nitrites, vinyl alcohols, acrylamides and methacrylamides, vinyl ketones, multifunctional monomers, and various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers that give water-soluble homopolymers, if the overall polymer composition is sufficiently water-insoluble to form a latex, and then to form a substantially water-impermeable film on drying. Further listings of suitable monomers for addition type polymers are found in U.S. Pat. No. 5,594,047 incorporated herein by reference. The polymers can be prepared by emulsion polymerization, solution polymerization, suspension polymerization, dispersion polymerization, ionic polymerization (cationic, anionic), atomic transfer radical polymerization, and other polymerization methods known in the art of polymerization. Polyurethane is a preferred material, examples of which are disclosed in commonly assigned U.S. Ser. No. 09/548,514 (Docket 80493) hereby incorporated by reference in its entirety. A water-dispersible polyurethane may be prepared as described in "Polyurethane Handbook," Hanser Publishers, Munich Vienna, 1985. Suitable polyurethanes are also commercially available from a variety of sources.

In one embodiment of the invention, the hydrophobic polymer can be selected so that fusing is not required, a potentially significant advantage compared to the prior art, for example U.S. Pat. No. 5,856,051, mentioned above. It has been found that once the biopolymer is hydrolyzed and degraded by the appropriate enzyme treatment, either during manufacture or during photographic processing or additional washing, then selected hydrophobic particles can coalesce even without fusing (which they would not otherwise do in the absence of the enzyme treatment of the biopolymer). Thus, the selection of hydrophobic particles to be used in the overcoat is based on the material properties one wishes to have as the protective overcoat.

The hydrophilic polymer used in this invention is a non-gelatin, enzyme-degradable biopolymer, including chemically modified derivatives thereof. The hydrophilic polymer, for example, may be selected from, for example, starch, cellulose, guar gum, xantham gum, pectin, chitin, and derivatives thereof, and other non-gelatin biopolymers derived from plants, animals, or microorganisms found in nature or genetically engineered. Combinations of one or more biopolymers may be used. Cellulose includes, for example, many derivatives such as methyl cellulose, hydroxyethyl cellulose, and carboxymethyl cellulose. A key feature of such biopolymers is that they are capable of being substantially digested by an enzyme that will not substantially digest gelatin. The biopolymer is preferably selected to be compatible with the hydrophobic polymer or latex, to facilitate application in a coating. Polysaccharides and naturally occurring or synthetic derivatives thereof are preferred.

The enzymes used in this invention include any enzyme, enzyme preparation, or enzyme-containing formulation capable of dissolving or degrading the non-gelatin biopolymer and substantially incapable of digesting gelatin under the conditions of use. Thus, "enzyme" in the context of this invention includes crude enzyme preparations, such as crude plant or bacterial fermentation broth extracts, as well as purified enzymes from plant, animal, or bacterial sources. The preparations of enzyme usable in the process are understood to include activators, cofactors, and stabilizers that are required for enzymatic activity, as well as stabilizers that enhance or preserve its activity. For example, when the biopolymer is a starch or starch derivative, an amylase or amylopectinase capable of hydrolyzing the swollen, dispersed starch may be employed. When the hydrophilic, enzyme-degradable biopolymer is a pectin, a pectinase enzyme can be used, and cellulose or derivatives thereof can be hydrolyzed with cellulase enzymes. The use of other biopolymers or modified biopolymers (derived from cellulose or chitin, for example) is also envisioned, coupled with the appropriate hydrolytic enzyme that can act on the biopolymer. For example, a commercially available cellulases are Carezyme® from Novo Nordisk and Ultra L-1000®, NCE L-600®, Antarctic FS®, and Neucel 404G® from Dyadic International, Inc. The use of combinations of these enzymes and enzyme types are also envisaged under this invention. Adducts of enzymes with synthetic polymers are also envisaged in which enzyme molecules are attached to synthetic polymers, which polymers may be larger or smaller than the enzyme.

Enzymes are biological catalysts. Similar to traditional chemical catalysts, enzymes speed the rate of biological reactions by producing a transition state with a lower energy of activation than the uncatalyzed reaction. In other words, enzymes are proteins specialized for the reactions they catalyze. The preferred enzymes employed in this invention are enzymes that catalytically hydrolyze the bonds of polysaccharides such as starches or celluloses. Examples of commercially available enzymes are described above. Other enzymes, preferably non-proteolytic, should also be suitable for this application. Combinations of more than one enzyme can also be used in such photochemical processing solutions.

The coating composition comprising the biopolymer and hydrophobic particles of the invention is advantageously applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008.

Another aspect of the present invention relates to a method of forming a water-resistant protective overcoat comprising application of an enzyme to a non-gelatin biopolymer-containing overcoat. The hydrophilic, biopolymer in the overcoat is digested and removed by one of the following methods, leading to a hydrophobic, water impermeable, protective layer:

Method I:

A solution of an appropriate hydrolytic enzyme is coated with the overcoat layer as part of the same or a subsequent coating operation, during the manufacture of the imaging element. In this case, digestion by the enzyme occurs before imaging and processing, and no substantial modifications of the photofinishing operation are required, though modification of the drying conditions at the end of the process may be desirable in order to facilitate formation of the protective layer. Alternatively, a separate fusing step could be included after processing.

Method II:

An appropriate hydrolytic enzyme is added in any one of the photographic processing solutions (e.g. developer, bleach, fix or blix) or in a wash tank at a concentration sufficient to hydrolyze the hydrophilic, enzyme-degradable biopolymer in the overcoat layer so that it becomes solubilized in the processing solution. A hydrophobic layer is formed when the photographic product of this invention is dried at the end of the photographic processing. Optionally, a high efficiency dryer or fuser can be used to speed, promote, or further complete the film formation process, depending on the hydrophobic material of choice used in the overcoat layer.

Method III:

An additional tank is added to the conventional processor, which contains a solution of the appropriate enzyme, separate and different from the existing process solutions. The location of this tank can be either prior to developer or after any of the conventional existing tanks. A hydrophobic layer is formed when the photographic product of this invention is dried by the dryer attached to the end of the photographic processing. Optionally, a high efficiency dryer or fuser can be used to promote/further complete film formation process, depending on the hydrophobic material of choice used in the overcoat layer.

Method IV:

The photographic product, after processing to develop images and drying, is immersed in an appropriate enzyme solution to remove the hydrophilic biopolymer in the overcoat layer, followed by appropriate drying to convert the overcoat layer to a water-resistant protective overcoat layer. Optionally, a fuser can be used subsequently to promote/further complete film formation process by the combination of heat and pressure, depending on the hydrophobic material of choice used in the overcoat layer.

In manufacturing the photographic element for use in Method I above, the enzyme is in reactive association with the biopolymer in the overcoat (nascent protective overcoat) but need not be in the same layer with the biopolymer. Thus, a separate layer containing the enzyme, typically in combination with a hydrophilic polymer, can be applied (preferably over the overcoat). This hydrophilic polymer can be natural and may be the same or different than the biopolymer (for example, gelatin or starch) or synthetic (for example, polyvinyl alcohol). The protective overcoat and enzyme can be applied separately from the imaging layer. The enzyme/overcoat can be applied in-line at a separate coating station after the topmost imaging layer is applied and allowed to dry. This can be referred to as a "two-pass" sequential operation. Alternatively, the enzyme can be applied separately (in a separate operation) from the imaging layer after the imaging layer has been allowed to harden. The latter manufacturing scheme has the disadvantage, however, that additional inventory is required.

Most preferably in Method I, however, all the layers comprising the photographic element (including the imaging layers, overcoat layer, and the layer containing enzyme) are applied simultaneously. Preferably, the coating solution for the overcoat of this invention is water-based, allowing the invention to be incorporated into the traditional manufacturing coating operation of photographic paper, for example, without any equipment modification. The presence of 10–50% by weight of hydrophilic biopolymer, especially in digested form, is sufficient to maintain proper permeability for processing solution to diffuse in and out for image development. Most preferably, the coatings are simultaneously applied at a single coating station by a slide hopper.

In Method I, it is desirable to formulate an enzyme solution with acceptable enzyme activity for an extended period of time. Compounds know to stabilize enzyme activity of liquid enzyme solutions may be employed.

In Methods II, III, and IV described above, the enzyme concentration may be dependent on the type of enzyme used, solution properties such as pH, ionic strength, osmolality, temperature, and other factors that affect enzyme activity and the time allowed for the photographic element to be immersed in the enzyme solution. Optionally, stabilizers are used to maintain constant enzyme activity in solution for extended period of time. It will be understood that variations and modifications of these methods leading to a water resistant overcoat layer may also be employed.

Thus, still another aspect of the present invention is directed to photochemical processing compositions that contain a non-proteolytic enzyme for hydrolyzing a biopolymer in the overcoat. The composition may be in solid form, for example tablets, capsules, powders and the like, which can be added to a conventional photoprocessing solution or form a novel photoprocessing solution. Alternatively, the photochemical processing composition may be in water-based liquid form, either a concentrated or unconcentrated solution. Such compositions, for treating a silver-halide light sensitive photographic element comprises (1) the non-proteolytic enzyme, (2) a photochemical selected from the group consisting of a developing agent for the imaging element, a fixing agent for removing insoluble silver halide salts, a bleaching agent for reoxidizing the silver to ionic silver state, photochemical stabilizers, or combinations thereof. For example, common bleaching agent are persulfate compounds or ferric complexes of an aminocarboxylic acid. Typical fixing agents are thiosulfate or thiocyanate compounds.

Referring again to photographic elements according to the present invention, additives can be incorporated into the overcoat composition that will give the overcoat various desired properties. For example, a dye can impart color or tint and/or a UV absorber may be incorporated into the composition to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent; preferably the concentration of organic solvent is less than 5 percent by weight of the total coating composition.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, for example a nonylphenoxypoly (glycidol) such as Olin 10G™ surfactant, available from Olin Matheson Corporation, or sodium octylphenoxypoly (ethyleneoxide) sulfate, organic sulfates or sulfonates, such as sodium dodecyl sulfate, sodium dodecyl sulfonate, sodium bis(2-ethylhexyl)sulfosuccinate, and alkylcarboxylate salts such as sodium decanoate.

The surface characteristics of the protective overcoat are in large part dependent upon the physical characteristics of the polymer used. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fuising element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in *Research Disclosure* No.

308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the overcoat composition may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly(trifluorochloroethylene), poly(vinylidene fluoride, poly(trifluorochloroethylene-co-vinyl chloride), poly(meth)acrylates or poly(meth)acrylamides containing perfluoroalkyl side groups, (5) polyethylene, and the like. Lubricants useful in the present invention are described in further detail in *Research Disclosure* No.308119, published December 1989, page 1006.

The laydown of the overcoat will depend on its field of application. For a photographic element, the total dry laydown is suitably 50 to 600 mg/ft$^2$, most preferably 100 to 300 mg/ft$^2$. It may be advantageous to increase the amount of gelatin in the overcoat as the laydown increases in order to improve the developability. The higher the laydown of the hydrophobic polymer component, the better the water resistance. On the other hand, increasing the laydown of hydrophobic particles, at some point, may tend to slow down the photographic development.

After applying the coating composition to the support, it may be dried over a suitable period of time, for example 2 to 4 minutes.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film or paper support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December 1978).

Photographic elements protected in accordance with this invention can be derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such as paper prints. Because of the amount of handling that can occur with paper prints and motion picture prints, they are the preferred photographic elements according to the present invention.

The photographic elements in which the images to be protected are formed can have the structures and components shown in Research Disclosure 37038 and 38957. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The element can contain additional layers, such as filter layers, interlayers, overcoat layers, subbing layers, and the like. All of these can be coated on a support which can be transparent (for example, a film support) or reflective (for example, a paper support). Support bases that can be used include both transparent bases, such as those prepared from polyethylene terephthalate, polyethylene naphthalate, cellulosics, such as cellulose acetate, cellulose diacetate, cellulose triacetate, and reflective bases such as paper, coated papers, melt-extrusion-coated paper, and laminated papers, such as those described in U.S. Pat. Nos. 5,853,965; 5,866,282; 5,874,205; 5,888,643; 5,888,681; 5,888,683; and 5,888,714. Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. Nos. 4,279,945 and U.S. Pat. No. 4,302,523.

Suitable silver halide emulsions and their preparation, as well as methods of chemical and spectral sensitization, are described in Sections I through V of Research Disclosure 37038 (or 38957). Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), so long as the substance is different from the biopolymer in the overcoat and not digested by the enzyme used to digest the overcoat. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, spolyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process*, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element or color paper element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver and silver halide, washing and drying.

In one embodiment of a method of using a composition according to the present invention, a photographic element may be provided with a processing-solution-permeable overcoat having the above described composition overlying the silver halide emulsion layer superposed on a support. The photographic element is developed in an alkaline developer solution having a pH greater than 7, preferably greater than 8, more preferably greater than 9. This allows the developer to penetrate the protective coating.

The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping.

The present invention is illustrated by the following Examples.

EXAMPLES

This example describes materials that can be used in the present invention. A water dispersible hydrophobic film-forming polymer, in this case a polyurethane referred to as PU-1, can be prepared as follows. Polycarbonate polyol PC17336® (3568 g, obtained from Stahl, Inc., a division of Zeneca Corporation), dimethylol propionic acid (372 g, 2.77 mol), diethylene glycol (289 g, 2.72 mol) and 1,4-butanediol (527 g, 5.85 mol) were dissolved in 6 kg dry methylethylketone (MEK). Approximately 2 kg of MEK was distilled off at 76–78° C. to dry the reagents. Isophorone diisocyanate (3447 g, 15.51 mol) and dibutyltin dilaurate (4.29 g) were added, and the reaction mixture heated at 90° C. for 5 hours and 100° C. for an additional 12 hours. An additional 1 kg of MEK was added, together with 25 g of isophorone diisocyanate, and heating was continued. When most of the isocyanate had been consumed (as determined by infrared spectroscopy of the reaction mixture), 3 kg acetone was added, and the temperature reduced to 40° C. A 45% solution of potassium hydroxide in water (315 g) was then added slowly with vigorous stirring, followed by 20 L of demineralized water. The organic solvents were distilled off at a jacket setpoint of 100° C., the distillation being stopped when the distillate temperature reached 95° C. The resulting milky suspension was adjusted to a solids content of 24.5% by addition of a small quantity of water.

Biopolymers and enzymes that are used in the following examples are listed, respectively, in Table 1 and Table 2 below.

TABLE 1

| Biopolymer | Commercial Source and Description |
|---|---|
| Melojel ® Starch | National Starch and Chemical Company; food grade starch from dent corn. |
| Tapioca Starch | National Starch and Chemical Company; food grade starch from cassava. |
| National Starch ® 6912 | National Starch and Chemical Company; modified food starch from waxy maize. |
| Penford ® Gum 280 Starch | Penford Products Company; hydroxyethylated corn starch. |
| Filmkote ® 54 Starch | National Starch and Chemical Company; modified cationic starch. |
| Catosize ® 240A Starch | National Starch and Chemical Company; modified cationic starch. |
| Amilys ® 220 Starch | Roquette Italia S.p.A.; oxidized starch from waxy maize. |

TABLE 2

| Enzyme | Source and manufacturer's comments |
|---|---|
| Termamyl ® 120L Amylase | Novo Nordisk A/S; fungal alpha-amylase from a genetically modified strain of *Bacillus licheniformis* (1,4-a-D-glucanglucanohydrolyase (EC 3.2.1.1) |
| Fungamyl ® 800L Amylase | Novo Nordisk A/S; fungal alpha-amylase from a strain of *Aspergillus oryzae* (1,4-a-D-glucanglucanohydrolyase (EC 3.2.1.1) |
| Maltogenase ® 4000L Amylase | Novo Nordisk A/S; maltogenic alpha-amylase from *Bacillus stearothermophilus*, produced by a genetically modified strain of *Bacillus subtilis*. |

Preparation of the Photographic Samples:

Multilayer Support S-1 was prepared by coating in sequence a blue-light sensitive layer, an interlayer, a green-light sensitive layer, a UV layer, a red-light sensitive layer, a UV layer and an overcoat on photographic paper support. The components in each individual layer are described below in Table 3 and Table 4 below.

TABLE 3

| Layer | Item | Laydown (mg/ft$^2$) |
|---|---|---|
| Layer 1 | Blue Sensitive Layer | |
| | Gelatin | 121.90 |
| | Blue-light sensitive AgX | 21.10 |
| | Y-1 | 38.50 |
| | Di-n-butyl phthalate | 17.33 |
| | ST-23 | 38.50 |
| | ST-16 | 0.88 |
| | Benzenesulfonic acid, 2,5-dihydroxy-4-(1-methylheptadecyl-, monopotassium salt | 0.88 |
| | 1-Phenyl-5-mercaptotetrazole | |
| Layer 2 | Interlayer | |
| | Gelatin | 70.00 |
| | ST-4 | 6.13 |
| | Di-n-butyl phthalate | 17.47 |
| | Disulfocatechol disodium | 6.00 |
| | Nitric acid | 0.524 |
| | SF-1 | 0.18 |
| Layer 3 | Green Sensitive Layer | |
| | Gelatin | 132.00 |
| | Green-light sensitive AgX | 7.30 |
| | M-1 | 22.10 |
| | Di-n-butyl phthalate | 7.85 |
| | Diundecyl phthalate | 3.36 |
| | ST-1 | 16.83 |
| | ST-2 | 5.94 |
| | ST-3 | 56.09 |
| | 1-Phenyl-5-mercaptotetrazole | 0.05 |
| Layer 4 | UV Layer | |
| | Gelatin | 66.00 |
| | UV-1 | 15.98 |
| | UV-2 | 2.82 |
| | ST-4 | 5.14 |

TABLE 3-continued

| Layer | Item | Laydown (mg/ft$^2$) |
|---|---|---|
| | Di-n-butyl phthalate | 3.13 |
| | 1,4-Cyclohexylenedimethylene Bis(2-ethylhexanoate) | 3.13 |
| Layer 5 | Red Sensitive Layer | |
| | Gelatin | 126.0 |
| | Red-light sensitive AgX | 18.70 |
| | C-1 | 35.40 |
| | Di-n-butyl phthalate | 34.69 |
| | 2-(2-Butoxyethoxy)ethyl acetate | 2.90 |
| | ST-4 | 0.29 |
| | UV-1 | 22.79 |
| | Silver phenyl mercaptotetrazole | 0.05 |
| | Benzenesulfonothioic acid,4-methyl-, potassium salt | 0.26 |
| Layer 6 | UV Layer | |
| | Gelatin | 50.00 |
| | UV-1 | 12.11 |
| | UV-2 | 2.13 |
| | ST-4 | 3.90 |
| | Di-n-butyl phthalate | 2.37 |
| | 1,4-Cyclohexylenedimethylene bis(2-ethylhexanote) | 2.37 |
| Layer 7 | Overcoat | |
| | Gelatin | 60.0 |
| | SF-1 | 1.00 |
| | SF-2 | 0.39 |
| | Bis(vinylsulfonyl)methane | 9.14 |

The Photographic Paper Support:

Sublayer 1: resin coat (Titanox and optical brightener in polyethylene)

Sublayer 2: paper

Sublayer 3: resin coat (polyethylene)

TABLE 4

| Reference No. | Structure |
|---|---|
| SF-1 Olin ® 10G | 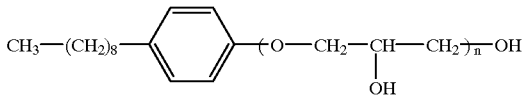 |
| SF-2 | $CF_3—(CF_2)_7—SO_3Na$ |
| Alkanol ® XC SF-3 | 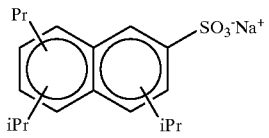 |
| SF-4 | 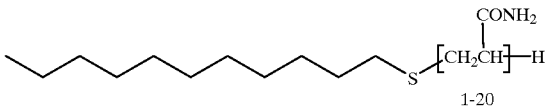 |

1-20

TABLE 4-continued
| Reference No. | Structure |
|---|---|
| UV-1 | 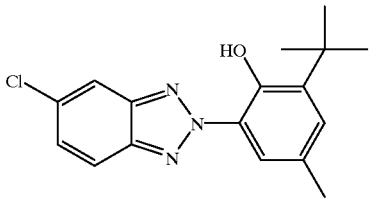 |
| UV-2 | 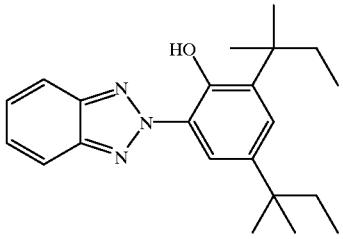 |
| C-1 | 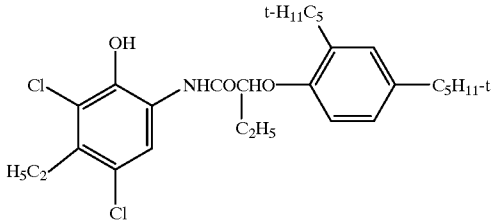 |
| M-1 | 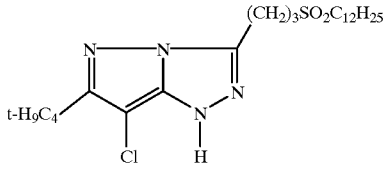 |
| ST-1 | 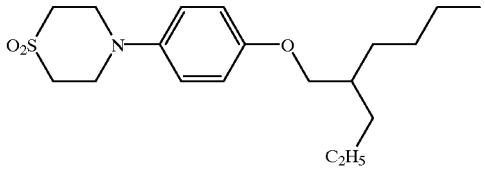 |
| ST-2 | 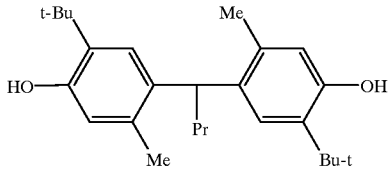 |
| ST-3 | 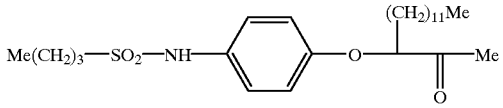 |

TABLE 4-continued

| Reference No. | Structure |
|---|---|
| ST-4 | 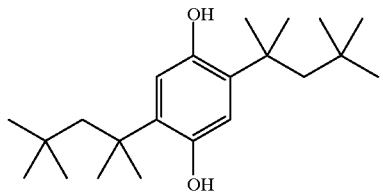 |
| Y-1 | 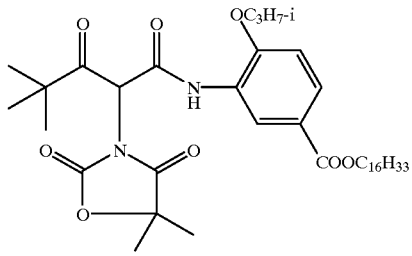 |
| ST-16 | 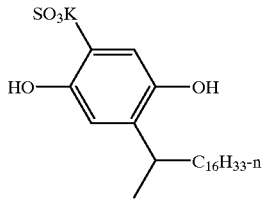 |
| ST-23 | 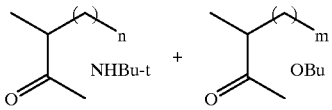 n:m = 1:1; mw = 75,000 - 100,000 |

Example 1

This Example illustrates the application of an enzyme to a photographic element during coating. Coatings were prepared with the following format:

| |
|---|
| Second-Pass Layer: |
| None (control) or solution of stock enzyme diluted 1:20 parts with water (invention) |
| First-Pass Layer: |
| 160 mg/ft$^2$ polyurethane PU-1 |
| 40 mg/ft$^2$ Starch in Table 6 and 7 |
| Multilayer support S-1 |

The overcoat layer (in the first-pass layer) and the enzyme solution were both applied using an extrusion hopper. In these coatings, various starch solutions prepared from commercial modified starches were used in the first coating pass (overcoat) over the imaging rug. All coatings were carried out in white light. Under these conditions, normal (RA-4) development will form maximum dye density in the element, which will therefore appear to be black. In all cases, processing using normal development did, in fact, generate high dye densities in all three colors. This observation indicated that the presence of the overcoat did not interfere substantially with normal processing chemistry, and that the overcoat was permeable to water and processing chemicals as coated. Further, it showed that no removal of the imaging layers has occurred as a result of the enzyme treatment, since under these conditions, a reduction in dye density in one or more of the imaging layers would be observed, and the coating would not appear to be black, but would instead appear to be red (if the cyan layer is removed), yellow (if the cyan and magenta layers are removed), or white (if all imaging layers are removed, and only the bare support remains).

Testing and Evaluation:

In order to assess the formation of an impermeable layer after processing, a process was used in which the developer solution of the normal process was replaced with a solution containing all the components of the normal process except for the developing agent (i.e., the p-phenylene diamine color developer). The coatings were immersed for 45 s in this solution, followed by the normal bleach/fix solution (45 s) and washing (180 s). All solutions were held at 38° C. At the end of this process, the coatings were dried in air. Two drying conditions were used: 38° C. for 30 m or 78° C. for 30 minutes. In a second series of experiments, samples were processed and dried as described, and then fused (passed through a pair of heated rollers under pressure) at 1 inch/s and a temperature of 160° C. Under these conditions, no silver development or dye formation could occur, and the coatings appeared white.

The formation of a water-resistant overcoat was tested by immersion of the dried coatings in a solution of Ponceau Red dye in 5% acetic acid/water for 5 minutes, washing, and drying once again. The dye adsorbs strongly to gelatin, so that if no protective layer is formed the coating is dyed a deep red color. A good protective layer prevents dye take-up, and the coating remains white. The dyed coatings were ranked according to the following scheme in Table 5:

TABLE 5

| Ranking | Performance |
|---|---|
| A | Remains white after drying; complete protection |
| B | Pale pink or occasional pink patches; partial protection |
| C | Pink or large pink or red patches or many pinholes; poor protection |
| D | Deep red; no protection |

Within an experiment, finer distinctions can be made, and are indicated in the following Table 6 by notations such as A− or C+. A ranking of A− would indicate that while the protection afforded by the processed overcoat is quite good, it is not quite so good as another coating in the same experimental set, ranked A. A ranking of C+, correspondingly, would indicate that the overcoat, while generally giving rather poor performance, is better than some other coating in the same set, ranked C. The results of this series of experiments are shown in the following Tables 6 and 8. The results in Table 6 was for samples dried at 38° C. for 30 minutes, whereas the results in Table 7 was for samples dried at 78° C.

TABLE 6

| Sample No. | Overcoat (First pass) Constituents in addition to PU-1 | Water overcoat, no enzyme (control) Not fused | Water overcoat, no enzyme (control) Fused | Enzyme overcoat, 100 mg/ft² Termamyl ® Enzyme 120L (invention) Not fused | Enzyme overcoat, 100 mg/ft² Termamyl ® Enzyme 120L (invention) fused |
|---|---|---|---|---|---|
| 1 | Penford ® 280 Starch, 0.1% Olin ® 10G SF-1 | D | D | C | B+ |
| 2 | Penford ® 280/Catosize ® 240A Starches, 35/5, 0.1% Olin ® 10G SF-1 | D | D | B | A |
| 3 | Penford ® 280/Filmkote ® 54 Starches, 35/5, 0.1% Olin ® 10G SF-1 | D | D | C+ | A− |
| 4 | National ® 6912 Starch, 0.1% Olin ® 10G SF-1 | D | D | D | B |
| 5 | National ® 6912/Catosize ® 240A Starches, 35/5, 0.1% Olin ® 10G SF-1 | D | D | D | B |
| 6 | National ® 6912/Filmkote ® 54 Starches, 35/5, 0.1% Olin ® 10G SF-1 | D | D | D | B+ |
| 7 | National ® 6912 Starch, 1% Olin ® 10G SF-1 | D | D+ | D+ | A |

TABLE 6-continued

| Sample No. | Overcoat (First pass) Constituents in addition to PU-1 | Water overcoat, no enzyme (control) Not fused | Water overcoat, no enzyme (control) Fused | Enzyme overcoat, 100 mg/ft² Termamyl ® Enzyme 120L (invention) Not fused | Enzyme overcoat, 100 mg/ft² Termamyl ® Enzyme 120L (invention) fused |
|---|---|---|---|---|---|
| 8 | National ® 6912 Starch, 0.1% Alkanol XC ® SF-3 | D | D | B | A |
| 9 | National ®6912 Starch, 0.1% SF-4 ® | D | D | B+ | A |
| 10 | Amilys ® 220 Starch, 1% Olin ® 10G SF-1 | D | C | D | B |
| 11 | Amilys ® 220 Starch, 1% Olin ® 10G SF-1 | D | D | C− | B |
| 12 | Amilys ® 220 Starch, 0.1% Alkanol XC ® SF-3 | D | D | C− | A |
| 13 | Amilys ® 220 Starch, 0.1% SF-4 | D | D | C− | A |
| 14 | Amilys ® 220/Catosize ® 240A Starches, 35/5, 0.1% Olin ® 10G SF-1 | D | D | D | C |

None of the control samples, after simple drying and without enzyme treatment during coating, showed any sign that the protective polymer formed a protective film after photographic processing. Even after fusing using heat and pressure, only one starch (Amylis® 220) allowed the formation of a protective layer, and the performance of that layer was poor (Sample No. 10, ranking C). In contrast, several of the coatings that had been treated with an enzyme solution during coating (invention) formed a protective overcoat whose performance was as good or better, even without fusing. With fusing, several samples formed a protective overcoat that was substantially impermeable to the dye and to water.

TABLE 7

| Sample No. | Overcoat (First pass) Constituents in addition to PU-1 | Water overcoat, no enzyme (control) Not fused | Water overcoat, no enzyme (control) Fused | Enzyme overcoat, 100 mg/ft² Termamyl ® Enzyme 120L (invention) Not fused | Enzyme overcoat, 100 mg/ft² Termamyl ® Enzyme 120L (invention) fused |
|---|---|---|---|---|---|
| 1 | Penford ® 280 Starch, 0.1% Olin ® 10G SF-1 | D | D | C | B |
| 2 | Penford ® 280/Catosize ® 240A Starches, 35/5, 0.1% Olin ® 10G SF-1 | D | D | B | A |
| 3 | Penford ® 280/Filmkote ® 54, 35/5, 0.1% Olin ® 10G | D | D | B | A− |
| 4 | National ® 6912 Starch, 0.1% Olin ® 10G SF-1 | D | D | C− | A− |
| 5 | National ® 6912/Catosize ® 240A Starches, 35/5, | D | D | B | A |

TABLE 7-continued

| Sample No. | Overcoat (First pass) Constituents in addition to PU-1 | Water overcoat, no enzyme (control) Not fused | Fused | Enzyme overcoat, 100 mg/ft² Termamyl ® Enzyme 120L (invention) Not fused | fused |
|---|---|---|---|---|---|
| | 0.1% Olin ® 10G SF-1 | | | | |
| 6 | National ® 6912/ Filmkote ® 54 Starches, 35/5, 0.1% Olin ® 10G SF-1 | D | D | D | B |
| 7 | National ® 6912 Starch, 1% Olin ® 10G SF-1 | D | D+ | C | A |
| 8 | National ® 6912 Starch, 0.1% Alkanol XC ® SF-3 | D | D | A | A |
| 9 | National ®6912 Starch, 0.1% SF-4 | D | D | D | A |
| 10 | Amilys ® 220 Starch, 1% Olin ® 10G SF-1 | D | C | C | A |
| 11 | Amilys ® 220 Starch, 1% Olin ® 10G SF-1 | D | D | B⁻ | B |
| 12 | Amilys ® 220 Starch, 0.1% Alkanol XC ® SF-3 | D | D | B⁻ | A |
| 13 | Amilys ® 220 Starch, 0.1% SF-4 | D | D | B | A |
| 14 | Amilys ® 220/ Catosize ® 240A Starches, 35/5, 0.1% Olin ® 10G SF-1 | D | D | D | C |

The data in this Table 7 demonstrate that high temperature drying can aid the formation of the protective film for those coatings that had been treated with enzyme (invention). In particular, Sample No. 8, prepared using National Starch® 6912 and Alkanol XC® surfactant gave a protective layer that showed an excellent ability to repel water and dye. However, the performance of the water-treated samples (control) was essentially equivalent to that shown under low temperature drying. When the coatings were fused, the performance of the coatings of the invention were similar to that of the coatings dried at low temperature, and then fused, with all of the starch/polymer overcoats giving some degree of protection, and several giving excellent protection.

Example 2

Samples were prepared as described in Example 1, using the same coating format. Three different starch derivatives were alternatively used, as shown in the following diagram.

| | | |
|---|---|---|
| Second-Pass Layer: water (control) or enzyme solution of stock enzyme diluted with water to give indicated laydowns (invention) | | |
| First-Pass Layer: | | |
| PU-1 plus Melojel ® (National Starch Co.) 11.4 mg/ft2 BVSM or Multilayer support S-1 | PU-1 plus Tapioca Starch (National Starch Co.) BVSM or | PU-1 plus National Starch ® 6912 (National Starch Co.) |

Processing and testing of the coatings was carried out as described in Example 1. Several different enzymes were used. The results are shown in Table 8 below.

TABLE 8

| Sample No. | Overcoat (First Pass) Constituents | Laydown of Enzyme Solution (mg/ft²) | Rating Not fused | Fused (320° F., 1 ips) |
|---|---|---|---|---|
| No enzyme overcoat (control): | | | | |
| 1 | Melojel ® (40 mg/ft²) polyurethane (160 mg/ft²) | 0 | D | D |
| 2 | Melojel ® (60 mg/ft²) polyurethane (160 mg/ft²) | 0 | D | D |
| 3 | Melojel ® (80 mg/ft²) polyurethane (160 mg/ft²) | 0 | D | D |
| 4 | Tapioca starch (40 mg/ft²) polyurethane (160 mg/ft²) | 0 | D | D |
| 5 | Tapioca starch (60 mg/ft²) polyurethane (160 mg/ft²) | 0 | D | D |
| 6 | Tapioca starch (80 mg/ft²) polyurethane (160 mg/ft²) | 0 | D | D |
| 7 | Starch 6912 ® (40 mg/ft²) polyurethane (160 mg/ft²) | 0 | D | D |
| 8 | Starch 6912 ® (60 mg/ft²) polyurethane (160 mg/ft²) | 0 | D | D |
| 9 | Starch 6912 ® (80 mg/ft²) polyurethane (160 mg/ft²) | 0 | D | D |
| Enzyme overcoated (invention): | | | | |
| 10 | Melojel ® Starch (40 mg/ft²) Termamyl ® 120L polyurethane (160 mg/ft²) | 10 | D | C |
| 11 | Melojel ® Starch (40 mg/ft²) Termamyl ® 120L polyurethane (160 mg/ft²) | 30 | D | C |
| 12 | Melojel ® Starch (40 mg/ft²) Termamyl ® 120L polyurethane (160 mg/ft²) | 100 | D | C |
| 13 | Melojel ® Starch (40 mg/ft²) Fungamyl ® 800L polyurethane (160 mg/ft²) | 10 | D | C |
| 14 | Melojel ® Starch (40 mg/ft²) Fungamyl ® 800L polyurethane (160 mg/ft²) | 30 | D | C |
| 15 | Melojel ® Starch (40 mg/ft²) Fungamyl ® 800L polyurethane (160 mg/ft²) | 100 | D | C |
| 16 | Melojel ® (40 mg/ft²) Maltogenase ® 4000L polyurethane (160 mg/ft²) | 10 | D | C |
| 17 | Melojel ® Starch (40 mg/ft²) Maltogenase ® 4000L polyurethane (160 mg/ft²) | 30 | D | C |
| 18 | Melojel ® Starch (40 mg/ft²) Maltogenase ® 4000L polyurethane (160 mg/ft²) | 100 | D | C |
| Enzyme overcoated (invention): | | | | |
| 19 | Tapioca Starch (40 mg/ft²) Termamyl ® 120L Polyurethane (160 mg/ft²) | 10 | D | C |
| 20 | Tapioca Starch (40 mg/ft²) Termamyl ® 120L polyurethane (160 mg/ft²) | 30 | C | C⁺ |
| 21 | Tapioca Starch (40 mg/ft²) Termamyl ® 120L Polyurethane (160 mg/ft²) | 100 | D* | D* |
| 22 | Tapioca Starch (40 mg/ft²) Fungamyl ® 800L Polyurethane (160 mg/ft²) | 10 | D | C |
| 23 | Tapioca Starch (40 mg/ft²) Fungamyl ® 800L polyurethane (160 mg/ft²) | 30 | D | D⁺ |
| 24 | Tapioca Starch (40 mg/ft²) fungamyl ® 800L Polyurethane (160 mg/ft²) | 100 | A | A |
| 25 | Tapioca Starch (40 mg/ft²) Maltogenase ® 4000L Polyurethane (160 mg/ft²) | 10 | A | B |
| 26 | Tapioca Starch (40 mg/ft²) | 30 | D* | D* |

TABLE 8-continued

| Sample No. | Overcoat (First Pass) Constituents | Laydown of Enzyme Solution (mg/ft$^2$) | Rating Not fused | Rating Fused (320° F., 1 ips) |
|---|---|---|---|---|
| | Maltogenase ® 4000L Polyurethane (160 mg/ft$^2$) | | | |
| 27 | Tapioca Starch (40 mg/ft$^2$) Maltogenase ® 4000L Polyurethane (160 mg/ft$^2$) | 100 | D* | D* |
| Enzyme overcoated (invention): | | | | |
| 28 | Starch 6912 ® (40 mg/ft$^2$) Termamyl ® 120L Polyurethane (160 mg/ft$^2$) | 10 | C | C+ |
| 29 | Starch 6912 ® (40 mg/ft$^2$) Termamyl ® 120L Polyurethane (160 mg/ft$^2$) | 30 | C | C+ |
| 31 | Starch 6912 ® (40 mg/ft$^2$) fungamyl ® 800L Polyurethane (160 mg/ft$^2$) | 10 | D | C |
| 32 | Starch 6912 ® (40 mg/ft$^2$) Fungamyl ® 800L Polyurethane (160 mg/ft$^2$) | 30 | D | C |
| 33 | Starch 6912 ® (40 mg/ft$^2$) Fungamyl ® 800L Polyurethane (160 mg/ft$^2$) | 100 | A | A |
| 34 | Starch 6912 ® (40 mg/ft$^2$) Maltogenase ® 4000L Polyurethane (160 mg/ft$^2$) | 10 | C | B |
| 35 | Starch 6912 ® (40 mg/ft$^2$) Maltogenase ® 4000L Polyurethane (160 mg/ft$^2$) | 30 | D | B |

*The protective layer was completely removed during processing.

As shown by Table 8, coatings 1–9 without enzyme treatment are completely permeable to water and processing solutions, and show high dye uptake, indicating that the mixture of starch and polyurethane does not give a barrier layer, either with or without fusing, in the absence of the applied enzyme. The same coatings treated with enzyme showed varying degrees of impermeability after processing. Some coatings showed excellent barrier performance (e.g., parts 24 and 33), and several showed at least some barrier properties (e.g., parts 10 through 18, where barrier properties are seen only after fusing, and parts 11 and 16, where the barrier properties are seen even without fusing). It should be noted that since these enzymes do not digest peptides, removal of the imaging layers, coated in gelatin, is extremely unlikely, and no sign of this phenomenon was observed even in cases in which the barrier layer was completely removed by enzymolysis (parts 21, 26, and 27).

Example 3

In contrast to Examples 1 and 2 above, this Example illustrates the application of enzyme to a photographic element according to the present invention during photographic processing. The coatings used in this Example were the control coatings from Example 1, that is, the coatings that had not been treated with enzyme solution during manufacture. This Example shows that a protective overcoat can be obtained by incorporating the enzyme treatment into the photographic process. As in Example 1, the "developer" solution contained all of the components of the RA-4 developer except for the color developer itself, in order to obtain a white image for testing, as explained in Example 1. The processing sequence is: 45 s in "Developer", 45 s in Bleach/Fix, 60 s in enzyme solution (a simple dilution of enzyme in water, and 120 s in wash. It can be seen that this sequence substitutes 60 s immersion in an enzyme-containing solution for the first 60 s of the wash; otherwise the processing sequence is identical to that of Example 1. Drying was carried out for 30 minutes at 38° C.; i.e., under the low temperature condition of Example 1. Two different enzyme concentrations were used, 0.5% and 2.0%. The coatings were evaluated for formation of an impermeable overcoat as described in Example 2, with the results shown in Table 9 (low enzyme concentration, 0.5% Fungamyl 800 L solution in the wash step) and 10 (high enzyme concentration, 2.0% Fungamyl 800 L solution in the wash step).

TABLE 9

| No. | Overcoat (First pass) Constituents | Wash in Water Only, No Enzyme (Control) Not fused | Wash in Water Only, No Enzyme (Control) fused | 0.5% Fungamyl ® 800L Enzyme in the Wash (Invention) fused | 0.5% Fungamyl ® 800L Enzyme in the Wash (Invention) fused |
|---|---|---|---|---|---|
| 1 | Penford ®280 Starch, 0.1% Olin ® 10G SF-1 | D | D | D | A |
| 2 | Penford ®280/ Catosize ® 240A Starches, 35/5, 0.1% Olin ® 10G SF-1 | D | D | D+ | A |
| 3 | Penford ® 280/ Filmkote ® 54 Starches, 35/5, 0.1% Olin ® 10G SF-1 | D | D | D | B+ |
| 4 | National ® 6912 Starch, 0.1% Olin ® 10G SF-1 | D | D | D | B |
| 5 | National ® 6912/Catosize ® 240A Starches, 35/5, 0.1% Olin ® 10G SF-1 | D | D | D | C |
| 6 | National ® 6912/Filmkote ® 54 Starches, 35/5, 0.1% Olin ® 10G SF-1 | D | D | D | C |
| 7 | National ® 6912 Starch, 1% Olin ® 10G SF-1 | D | D+ | D | A |
| 8 | National ® 6912 Starch, 0.1% Alkanol XC ® SF-3 | D | D | D | A– |
| 9 | National ® 6912 Starch, 0.1% SF-4 | D | D | D+ | A– |
| 10 | Amilys ® 220 Starch, 1% Olin ® 10G SF-1 | D | C | D | A |
| 11 | Amilys ® 220 Starch, 0.1% Olin ° 10G SF-1 | D | D | D | A |
| 12 | Amilys ® 220 Starch, 0.1% Alkanol XC ® SF-3 | D | D | D | A |
| 13 | Amilys ® 220 Starch, 0.1% SF-4 | D | D | D | A |
| 14 | Amilys ® 220/Catosize ® 240A Starches, 35/5, 0.1% Olin ® 10G SF-1 | D | D | D | A– |

TABLE 10

| No. | Overcoat (First pass) Constituents | Wash in Water Only, No Enzyme (Control) Not fused | Wash in Water Only, No Enzyme (Control) fused | 0.5% Fungamyl ® 800L Enzyme in the Wash (Invention) fused | 0.5% Fungamyl ® 800L Enzyme in the Wash (Invention) fused |
|---|---|---|---|---|---|
| 1 | Penford ®280 Starch, 0.1% Olin ® 10G SF-1 | D | D | D | A |
| 2 | Penford ®280/ Catosize ® 240A Starches, 35/5, 0.1% Olin ® 10G SF-1 | D | D | D+ | A– |

TABLE 10-continued

| No. | Overcoat (First pass) Constituents | Wash in Water Only, No Enzyme (Control) Not fused | fused | 0.5% Fungamyl ® 800L Enzyme in the Wash (Invention) fused | fused |
|---|---|---|---|---|---|
| 3 | Penford ® 280/ Filmkote ® 54 Starches, 35/5, 0.1% Olin ® 10G SF-1 | D | D | D | A |
| 4 | National ® 6912 Starch, 0.1% Olin ® 10G SF-1 | D | D | D | A |
| 5 | National ® 6912/Cato-size ® 240A Starches, 35/5, 0.1% Olin ® 10G SF-1 | D | D | D | A– |
| 6 | National ® 6912/Film-kote ® 54 Starches, 35/5, 0.1% Olin ® 10G SF-1 | D | D | D | A |
| 7 | National ® 6912 Starch, 1% Olin ® 10G SF-1 | D | D+ | D | A– |
| 8 | National ® 6912 Starch, 0.1% Alkanol XC ® SF-3 | D | D | D | B+ |
| 9 | National ® 6912 Starch, 0.1% SF-4 | D | D | B | A |
| 10 | Amilys ® 220 Starch, 1% Olin ® 10G SF-1 | D | C | D | A |
| 11 | Amilys ® 220 Starch, 0.1% Olin ° 10G SF-1 | D | D | D | A |
| 12 | Amilys ® 220 Starch, 0.1% Alkanol XC ® SF-3 | D | D | D | B |
| 13 | Amilys ® 220 Starch, 0.1% SF-4 | D | D | D | A |
| 14 | Amilys ® 220/Cato-size ® 240A Starches, 35/5, 0.1% Olin ® 10G SF-1 | D | D | D | A– |

The third and fourth columns in these Tables 9 and 10 are the same as in Table 3 in Example 1, and they show that with simple washing in water and no enzyme treatment, no protective overcoat is formed. When an enzyme capable of hydrolyzing the starch is used at low concentration in the wash solution, in contrast, Table 9 shows that several of the coatings form a good protective layer on fusing. With higher enzyme concentrations, some of the coatings form a protective overcoat with reasonably good properties even without a fusing step (TABLE 10, Sample No. 9, ranking B; Sample No. 8, ranking C). With fusing, many of these samples showed excellent performance.

What is claimed is:

1. A photographic element comprising:

a support;

at least one light sensitive silver-halide emulsion imaging layer comprising a gelatin binder superposed on the support; and an overcoat layer overlying the at least one light sensitive silver halide emulsion imaging layer, which overcoat comprises particles of a film-forming hydrophobic polymer mixed with a biopolymer other than gelatin;

further comprising an enzyme capable of digesting the biopolymer in the overcoat layer but which is not capable of substantially digesting gelatin, which enzyme is in reactive association with the overcoat layer for digesting the biopolymer in the overcoat layer.

2. The photographic element of claim 1 where the biopolymer is a polysaccharide selected from the group consisting of starch, cellulose, guar gum, xantham gum, pectin, chitin, and derivatives thereof.

3. The photographic element of claim 1 wherein the hydrophobic polymer has a weight average molecular weight between 10,000 and 5,000,000.

4. The photographic element of claim 1 in which the enzyme is selected from the group consisting of cellulases, amylases, and pectinases.

5. The photographic element of claim 4 wherein the enzyme is a bacterial amylase.

6. The photographic element of claim 1 in which the enzyme is contained in a layer separate from the overcoat layer in combination with a hydrophilic polymer.

7. The photographic of claim 6 in which an enzyme-containing layer contains a hydrophilic polymer that is not capable of being digested by the enzyme.

8. The photographic element of claim 1 wherein the overcoat further comprises UV absorbers, speed control dyes, surfactants, emulsifiers, coating aids, lubricants, matte particles, rheology modifiers, crosslinking agents for the gelatin, antifoggants, inorganic fillers, pigments, magnetic particles and/or biocides.

9. The photographic element of claim 1 further comprising an antistatic layer superposed on the support.

10. The photographic element of claim 1 further comprising a transparent magnetic layer superposed on the support.

11. The photographic element of claim 1 wherein the support is transparent.

12. The photographic element of claim 1 wherein the support is reflective.

13. The photographic element of claim 1 wherein the hydrophobic polymer has a Tg between 0 and 80° C.

14. A photographic element comprising:

a support;

a silver halide emulsion layer superposed on a side of said support;

a processing solution permeable protective overcoat made from a composition comprising, by dry weight, 10 to 50% by weight of a polysaccharide or derivative thereof and 50 to 90% by weight of hydrophobic water-insoluble particles having an average diameter of 10 to 500 nm, at least 50% percent of the particles comprising a polymer having a Tg of less than 80° C., such that the hydrophobic particles will coalesce to form a continuous layer after the polysaccharide is enzymatically removed.

15. A method of making a photographic element with a water-resistant protective overcoat; the method comprising (i) providing a photographic element comprising a support, at least one silver-halide emulsion imaging layer comprising a gelatin binder superposed on a side of said support, a processing-solution-permeable overcoat overlying the silver-halide emulsion imaging layer, said overcoat comprising a hydrophobic polymer mixed with a biopolymer other than gelatin, (ii) imagewise exposing the photographic element to light; and (iii) developing the photographic element in a developer solution having a pH greater than 7; the method further comprising (a) treating the photographic element with an enzyme that digests the biopolymer in the overcoat but which does not substantially digest gelatin in any imaging layer; and (b) removing the digested biopolymer from the overcoat;

(c) coalescing the hydrophobic polymer in the overcoat, thereby forming a water-resistant protective overcoat.

16. The method of claim 15 wherein the overcoat comprises 10 to 50% of the biopolymer and 50 to 90% by weight of hydrophobic polymer applied in the form of particles having an average diameter of 10 to 500 nm.

17. The method of claim 15 wherein the photographic element further comprises an enzyme capable of digesting the biopolymer in the overcoat, which enzyme is in the overcoat and/or in a separate layer from which the enzyme can diffuse into the overcoat to digest the biopolymer.

18. The method of claim 17 wherein the enzyme was incorporated in the photographic element during its manufacture.

19. The method of claim 17 wherein the enzyme is applied as part of a photoprocessing solution.

20. The method of claim 19 wherein the photoprocessing solution is a developing, bleaching, fixing, bleach-fixing, wash/stabilizer solution, or in a special separate solution incorporated as part of a photoprocess.

21. The method of claim 20 wherein the enzyme is in the developer.

22. The method of claim 20 wherein the enzyme is in the bleach-fixing solution.

23. The method of claim 19 wherein the enzyme is in the wash/stabilizer solution.

24. The method of claim 15 wherein the enzyme is applied after the element is washed and dried.

25. The method of claim 15 in which the method employs RA-4 chemistry to produce a colored image.

26. The method of claim 15 comprising treatment of the photographic element with heat, or with pressure and heat, to form a protective water-repellent overcoat layer.

27. The method of claim 15 further comprising fusing the overcoat by the application of heat.

28. The method of claim 15 comprising treatment of the overcoat with radiant heat to form a protective water-repellent overcoat layer.

* * * * *